US008567080B2

(12) United States Patent
Yang et al.

(10) Patent No.: US 8,567,080 B2
(45) Date of Patent: Oct. 29, 2013

(54) METHOD OF MEASURING AND IDENTIFYING FOOT ARCH TYPE

(75) Inventors: Sai-Wei Yang, Taipei (TW); Keh-Tao Liu, Taipei (TW); Chao-Yi Cheng, Taipei (TW)

(73) Assignee: Global Action Inc., Taipei (TW)

( * ) Notice: Subject to any disclaimer, the term of this patent is extended or adjusted under 35 U.S.C. 154(b) by 110 days.

(21) Appl. No.: 13/337,768

(22) Filed: Dec. 27, 2011

(65) Prior Publication Data

US 2012/0174423 A1 Jul. 12, 2012

(30) Foreign Application Priority Data

Jan. 7, 2011 (TW) ..... 100100724 A

(51) Int. Cl.
*A61B 5/103* (2006.01)

(52) U.S. Cl.
USPC ..... 33/512; 33/515

(58) Field of Classification Search
USPC ..... 33/512, 514.2, 515
See application file for complete search history.

(56) References Cited

U.S. PATENT DOCUMENTS 5,640,779 A * 6/1997 Rolloff et al. ..... 33/514.2
6,160,264 A * 12/2000 Rebiere ..... 33/515
6,219,929 B1 * 4/2001 Tasker et al. ..... 33/515
6,293,026 B1 * 9/2001 Lee et al. ..... 33/512
6,493,958 B1 * 12/2002 Tadin ..... 33/515
6,625,897 B2 * 9/2003 Tadin ..... 33/515
6,904,692 B2 * 6/2005 Tadin ..... 33/515
7,336,377 B2 * 2/2008 Danenberg et al. ..... 356/635
7,346,998 B2 * 3/2008 Tadin et al. ..... 33/515
7,549,232 B2 * 6/2009 Tadin ..... 33/515
7,854,071 B2 * 12/2010 Goonetilleke et al. ..... 33/515
7,950,163 B2 * 5/2011 Lo ..... 33/515
2006/0225297 A1 * 10/2006 Tadin et al. ..... 33/515
2008/0028625 A1 * 2/2008 Nudelman et al. ..... 33/515
2010/0058855 A1 * 3/2010 Tadin et al. ..... 33/515
2010/0293799 A1 * 11/2010 Lo ..... 33/515
2011/0288446 A1 * 11/2011 Hsieh et al. ..... 600/592
2012/0174423 A1 * 7/2012 Yang et al. ..... 33/512

* cited by examiner

*Primary Examiner* — Yaritza Guadalupe-McCall
(74) *Attorney, Agent, or Firm* — C. G. Mersereau Nikolai & Mersereau, P.A.

(57) ABSTRACT

The invention provides a method of measuring and identifying foot arch type according to footprint data. The method includes: obtaining a static standing footprint having a foot contour including lateral and medial contours; obtaining a lateral ball and lateral heel tangent points of the footprint, and a medial ball and a medial heel tangent point of the footprint; obtaining a ball and a heel mid-point; obtaining a foot center axial line and a foot perpendicular bisector; obtaining the length of a foot width Lf as the length of the foot perpendicular bisector, and the width a foot arch La; and calculating a foot type index FTI by dividing the width of the foot arch La by the length of the foot width Lf (FTI=La/Lf), and identifying a foot arch type of the footprint by the foot type index FTI.

4 Claims, 4 Drawing Sheets

(a) (b)

(a) (b)

METHOD OF MEASURING AND IDENTIFYING FOOT ARCH TYPE

FIELD OF THE INVENTION

The present invention relates to technology of categorizing foot shape, and particularly to a method of measuring and identifying foot arch type according to a consumer's footprint data in order to provide suitable insoles or shoes.

BACKGROUND

Foot arch is part of a human foot structure providing shock absorption in walking or exercising to reduce the risk of foot injuries. Generally, a foot arch type can be determined by the height of the foot arch, which refers to the distance from the medial longitudinal foot arch to the ground. Typically, the perpendicular distance from the lower rim of the navicular tuberosity to the ground is used as an index; a high arched foot and low arched foot if the distance is too large or too small. If the distance is smaller to a certain level, the foot is referred to as a flat foot. In recent years, studies have shown a close relationship between abnormal arch height (high or low arch) and sport related injury to lower limbs.

Foot arch type can be evaluated by a variety of ways, such as medical instruments (X-ray examination, ultrasound examination), measuring instruments (caliper measurement, foot type measurement), footprint observation and experimentation (footprint parameters, wet foot test). Due to its easy, convenient and non-invasive characteristics, the footprint is more commonly used for measurement of the height of foot arch. In footprint analysis, geometrical methods such as calculation of line segment lengths, angles and areas are widely used for estimation, and commonly utilized footprint parameters include the arch angle, the footprint index, the arch index (AI), the arch length index and the truncated arch index. The most commonly used arch index (AI) is disclosed by Cavanagh and Rodgers in 1985. It is calculated by obtaining a footprint under a static standing stance, and dividing the length L of the footprint area without toes equally into three sections (referring to FIG. 1), and then obtaining the areas of the three sections, including the rear foot area (A), the mid foot area (B) and the forefoot area (C). The arch index (AI) is calculated by dividing the mid foot area to the total foot area (without the toes), which means AI=B/(A+B+C). When the arch index AI is smaller than 0.21, the foot arch type is high arch. When the arch index AI is between 0.21 and 0.26, the foot arch type is normal arch. When the arch index AI is larger than 0.26, the foot arch type is flat foot.

However, calculation of the footprint parameters requires complex steps and huge calculation cost (such as footprint area integral). Thus, the identification of foot arch type is generally not complete in a short time and cannot provide suitable insoles or shoes for the consumer.

Therefore, in view of the aforementioned technical problems, there is a need for a method of measuring and identifying foot arch type to solve the aforementioned problems.

SUMMARY OF THE INVENTION

An objective of the present invention is to provide a method of measuring and identifying foot arch type, which is convenient and can be performed with low cost and non-invasive to human body.

To achieve the foregoing objectives of the invention, the invention provides a method of measuring and identifying foot arch type according to footprint data. The method comprises: obtaining a footprint under a static standing stance, the footprint having a foot contour comprising lateral contour and medial contour; obtaining a lateral ball tangent point and a lateral heel tangent point of the footprint at points of contact between the lateral contour of the footprint and a lateral common tangent of the lateral contour of the footprint; obtaining a medial ball tangent point and a medial heel tangent point of the footprint at points of contact between the medial contour of the footprint and a medial common tangent of the medial contour of the footprint; obtaining a ball mid-point at the mid-point on a line between the lateral ball tangent point and the medial ball tangent point, and a heel mid-point at the mid-point on a line between the lateral heel tangent point and the medial heel tangent point; obtaining a foot center axial line connecting the ball mid-point and the heel mid-point, the foot center axial line contacting the foot contour at a distal forefoot point and a proximal heel point; obtaining a foot perpendicular bisector perpendicular to the foot center axial line at a foot center axial line dividing point, the foot center axial line dividing point being a mid-point between the distal forefoot point and the proximal heel point, the foot perpendicular bisector contacting the medial contour at a perpendicular bisecting medial arch point, the foot perpendicular bisector contacting the medial common tangent at a medial common tangent point, and the foot perpendicular bisector contacting the lateral common tangent at a lateral common tangent point; obtaining the length of a foot width Lf of a line segment between the medial common tangent point and the lateral common tangent point, and obtaining the width of a foot arch La of a line segment between the perpendicular bisecting the medial arch point and the lateral common tangent point; and calculating a foot type index FTI by dividing the width of the foot arch La by the length if the foot width Lf, that is, FTI=La/Lf.

According to the foot type index FTI, a foot arch type of the footprint can be identified. For example, the foot arch type can be categorized as one of the five categories, including flat foot, low arch, normal (or regular) arch, little high arch, and high arch. Alternatively, the foot arch type can be categorized as one of the three categories, including flat foot, normal arch and high arch.

The method of measuring and identifying foot arch type has the advantages of: (1) Linear measurement and identification of the footprint data are performed, which is convenient and non-invasive; and (2) the results are obtained by linear geometrical calculation to the footprint data, which does not require complex calculation, thus reducing calculation cost and time.

The above-mentioned summary of the invention is not provided to limit the scope of the invention. Embodiments of the invention will be described in detail in the following paragraphs of detailed description of the embodiments. It should be noted that the summary of the invention paragraphs are not provided to identify the key features or the basic characteristics of the invention, and do not construe the sole basis of the scope of the invention.

DETAILED DESCRIPTION OF THE INVENTION

The techniques employed by the present invention to achieve the foregoing objectives and the effects thereof are described hereinafter by way of examples with reference to the accompanying drawings. In the following descriptions, elements with the same functions are denoted by the same denoting numbers. The invention is described by its features in accordance to the requirements of the patent law, and the descriptions are not intended to limit the scope of the invention. It is possible that the invention can be embodied by ways other than as described by the inventors, such as ways to include a different step in the method or to combine a few steps described hereafter into one combined step or to combine other current or future techniques into the invention. Although the term "step(s)" may be used to describe a part of performance in the process or method, it does not imply any specific sequence existing between the steps of the process or the method.

Figure 1:
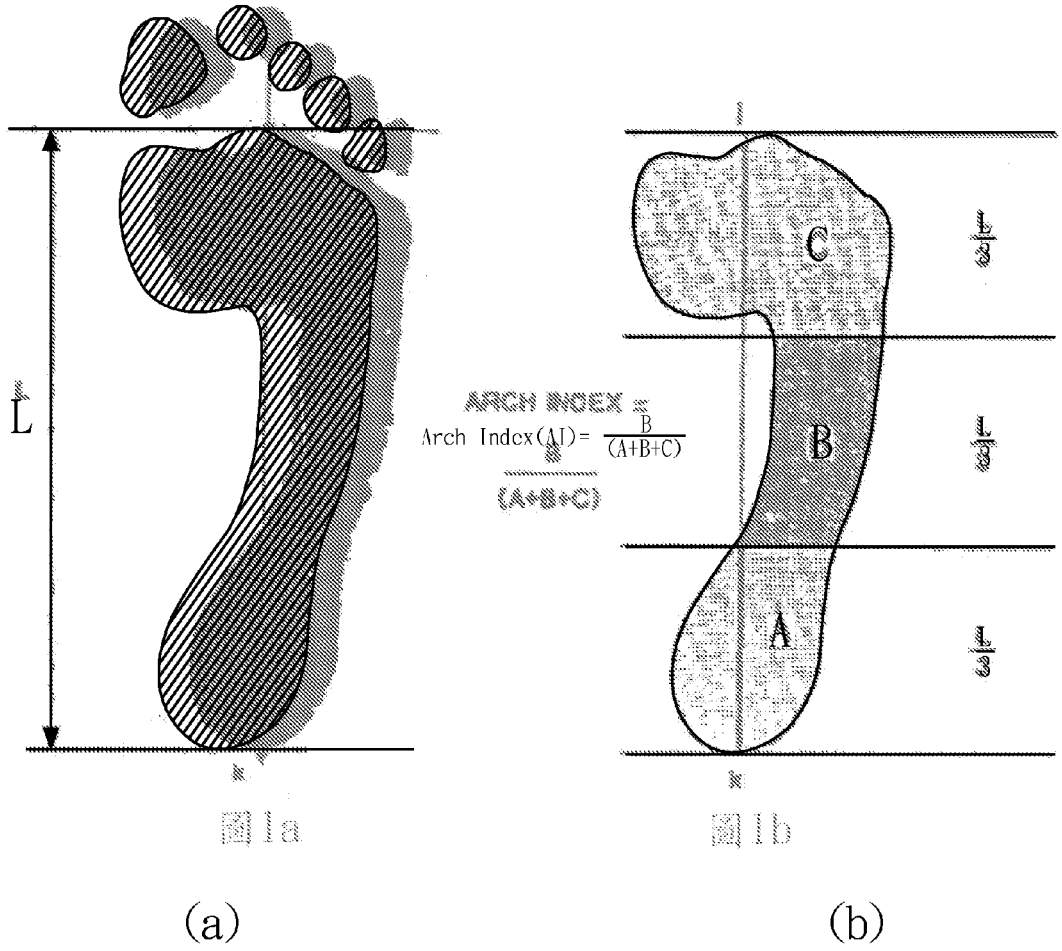
FIGS. 1*a* and 1*b* are schematic views of calculation in the conventional method of arch index measurement.
Figure 2:
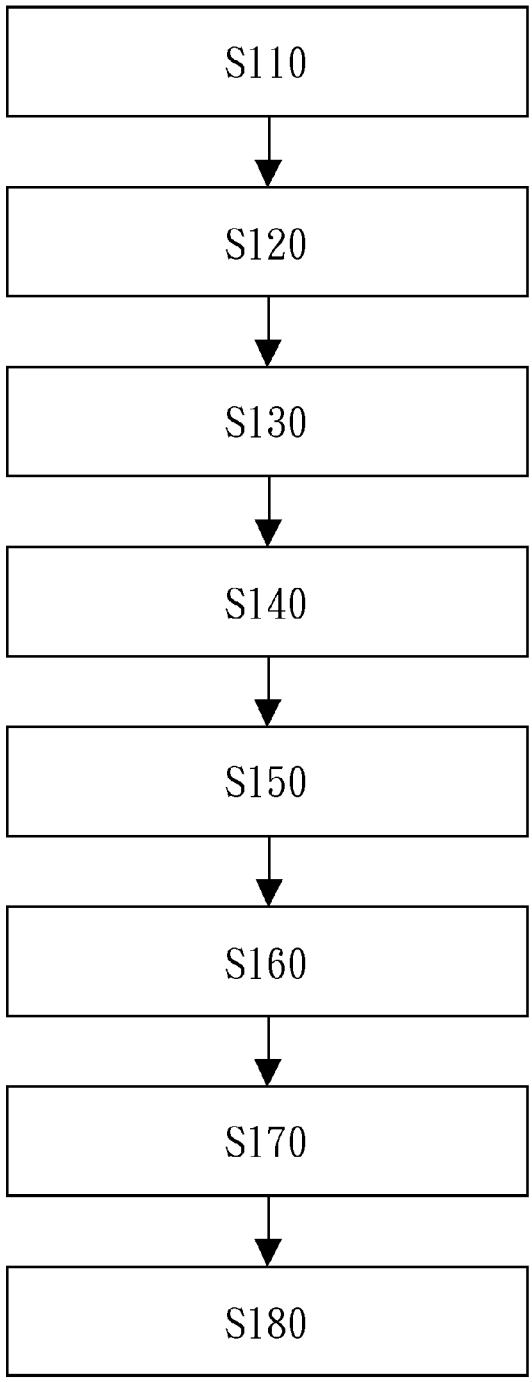
FIG. 2 is a flow chart of the method of measuring and identifying foot arch type of the present invention.
Figure 3:
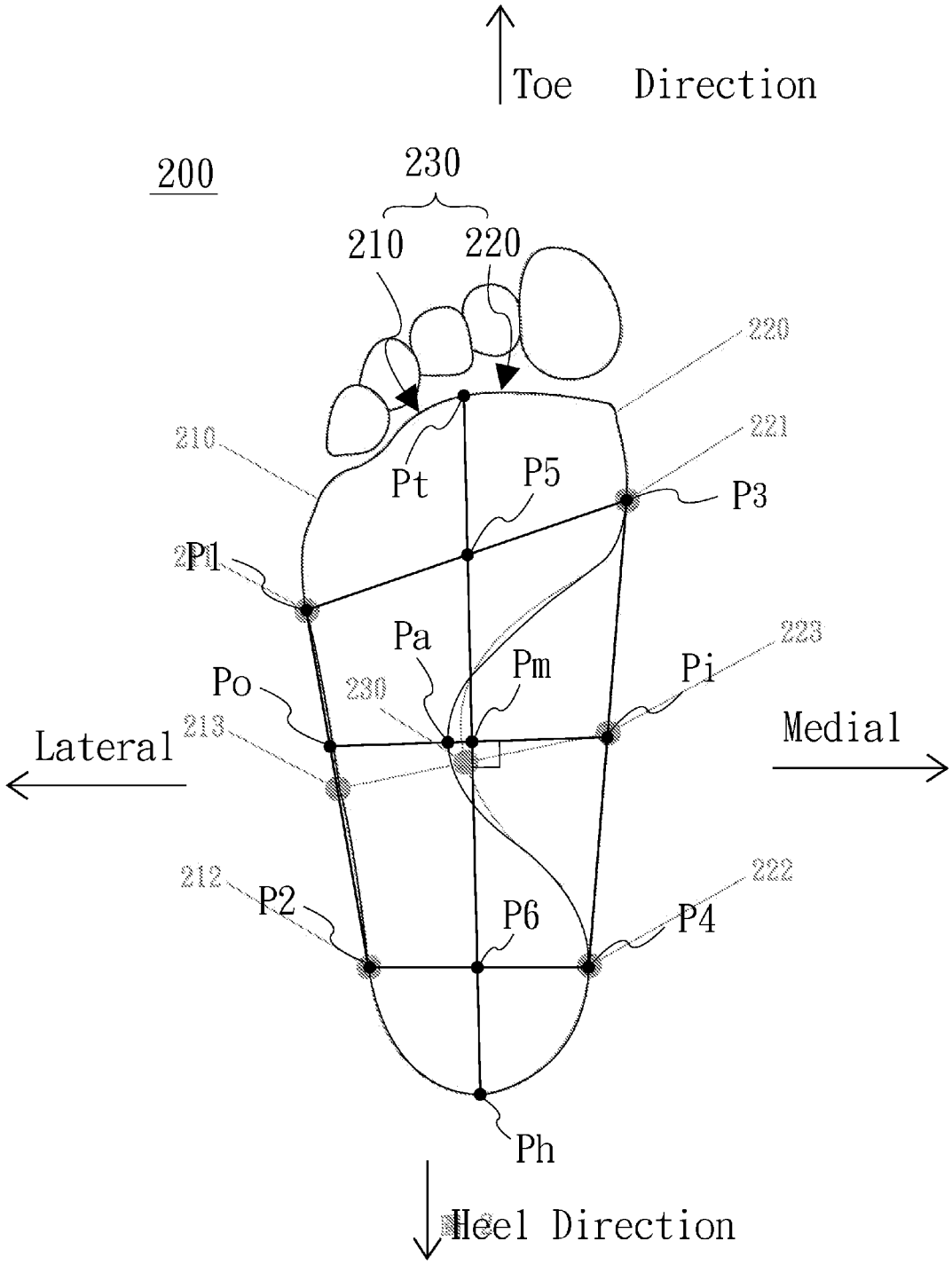
FIG. 3 is a schematic view of the measurement points used in the method of measuring and identifying foot arch type of the present invention.

Referring to FIG. 2 and FIG. 3, which include a flow chart of the method of measuring and identifying foot arch type of the present invention and a schematic view of the measurement points used in the method of measuring and identifying foot arch type. The method is described hereafter in detail.

In step S110, a footprint 200 is obtained when the foot of the person is measured under a static standing stance. The footprint 200 has a foot contour 230, which comprises lateral contour 210 and medial contour 220.

In step S120, a lateral ball tangent point P1 and a lateral heel tangent point P2 of the footprint are obtained at points of contact, respectively in the ball and heel areas, between the lateral contour 210 of the footprint and a lateral common tangent P1-P2 of the lateral contour 210 of the footprint.

Similarly, in step S130, a medial ball tangent point P3 and a medial heel tangent point P4 of the footprint are obtained at points of contact, respectively in the ball and heel areas, between the medial contour 220 of the footprint and a medial common tangent P3-P4 of the medial contour 220 of the footprint.

In step S140, a ball mid-point P5 and a heel mid-point P6 are obtained. The ball mid-point P5 is at the mid-point on a line between the lateral ball tangent point P1 and the medial ball tangent point P3, and the heel mid-point P6 is at the mid-point on a line between the lateral heel tangent point P2 and the medial heel tangent point P4.

In step S150, a foot center axial line Pt-Ph is obtained, connecting the ball mid-point P5 and the heel mid-point P6. The foot center axial line contacts the foot contour 230 at a distal forefoot point Pt and a proximal heel point Ph.

In step S160, a foot perpendicular bisector Pi-Po is obtained. The foot perpendicular bisector is perpendicular to the foot center axial line Pt-Ph at a foot center axial line dividing point Pm, and the foot center axial line dividing point Pm is a mid-point between the distal forefoot point Pt and the proximal heel point Ph. The foot perpendicular bisector Pi-Po contacts the medial contour 220 at a perpendicular bisecting the medial arch point Pa, and contacts the medial common tangent P3-P4 at a medial common tangent point Pi, and contacts the lateral common tangent P1-P2 at a lateral common tangent point Po.

In step S170, the length of a foot width Lf of the line segment Pi-Po between the medial common tangent point Pi and the lateral common tangent point Po is obtained, and the width of a foot arch La of the line segment Pa-Po between the perpendicular bisecting the medial arch point Pa and the lateral common tangent point Po.

In step S180, by dividing the width of the foot arch La by the length of the foot width Lf, a foot type index FTI is obtained, which means FTI=La/Lf.

According to the foot type index FTI, a foot arch type can be categorized as one of three categories, including flat foot, normal arch and high arch. Alternatively, the foot arch type can be categorized in further detail as one of the five categories, including flat foot, low arch, normal arch, little high arch, and high arch. According to the foot type index FTI, it can identify the consumer's foot type and provide suitable insoles or shoes.

In practice, various tools can be utilized to obtain the footprint 200, such as an electronic scanner, a Harris and Beath footprinting mat, a pressure sensor, a thermal sensor and wet foot test. With data obtained in experimentation, the foot type index FTI is proved to be highly related to the arch index AI with any type of footprint 200 obtaining from measurement tools. For example, when an electronic scanner is used to obtain the footprint 200, the arch index AI and the foot type index FTI are calculated and performed regression analysis. The result shows a relation between the arch index AI and the foot type index FTI that:

$$AIe=0.31(FTIe)+0.0913$$

where a correlation coefficient $\rho=0.925$ exists between the values AIe and FTIe. In order to avoid confusion, the arch index calculated from the footprint 200 obtained with the electronic scanner is denoted by AIe, and the foot type index calculated is denoted by FTIe.

Alternatively, when a thermal sensor is used to obtain the footprint 200, the arch index AI and the foot type index FTI are calculated and performed regression analysis. The result shows a relation between the arch index AI and the foot type index FTI that:

$$AIt=0.26(FTIt)+0.1274$$

where a correlation coefficient $\rho=0.951$ exists between the values AIt and FTIt. Similarly, in order to avoid confusion, the arch index calculated from the footprint 200 obtained with the thermal sensor is denoted by AIt, and the foot type index calculated is denoted by FTIt.

Figure 4:
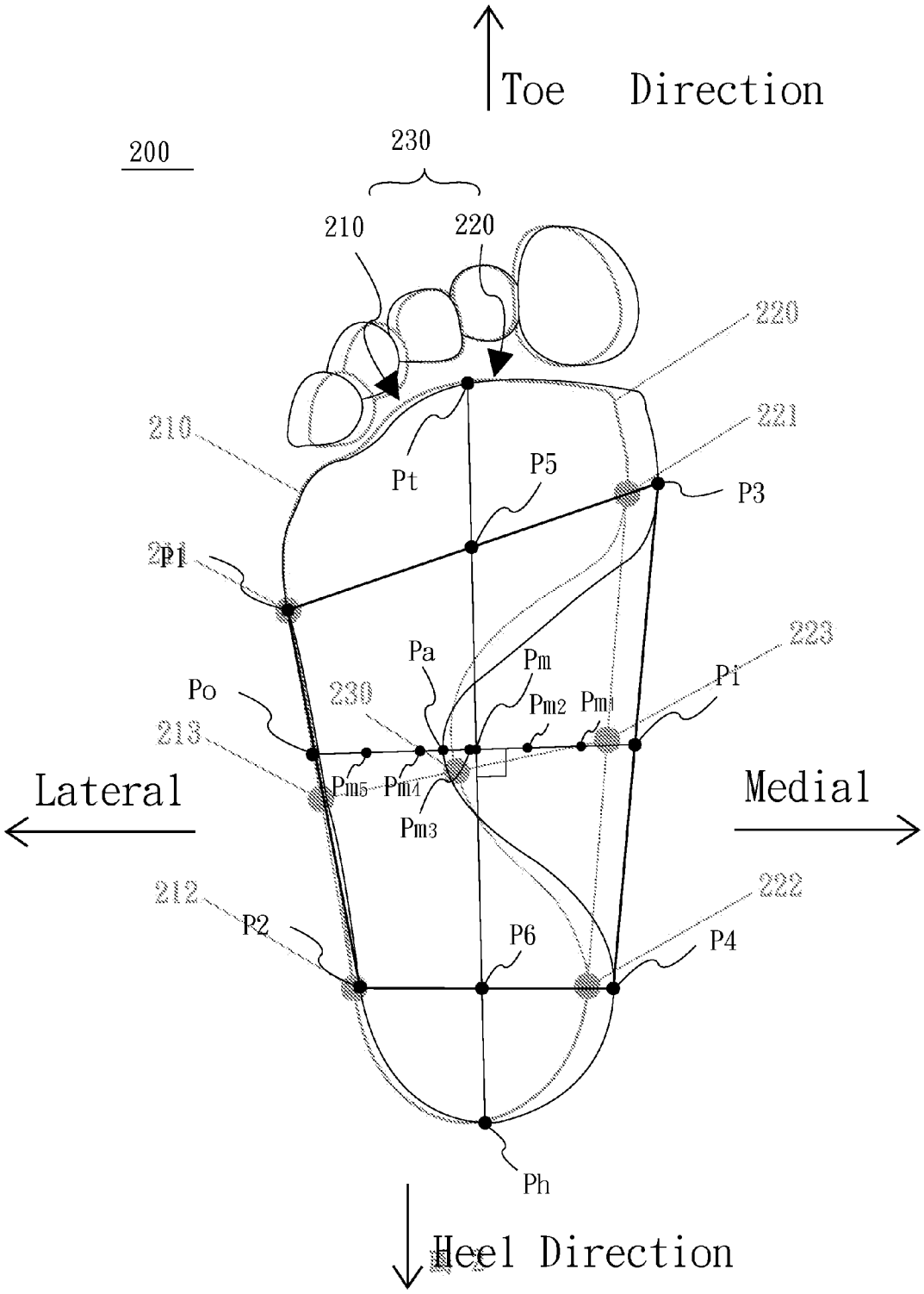
FIG. 4 is a schematic view of the one-sixth method applied in an embodiment of the invention.

Referring to FIG. 4, which is a schematic view of the one-sixth method applied in an embodiment of the invention. According to FIG. 4, five points are provided; dividing the line segment Pi-Po of the foot perpendicular bisector with the length of the foot width Lf equally into six segments, and defining a one-sixth foot type index $FTI_6$ by dividing the length of the line segment Pi-Pa by the length of the foot width Lf. When the perpendicular bisecting the medial arch point Pa falls between the medial common tangent point Pi and a flat foot point Pm2, the one-sixth foot type index $FTI_6$ is larger than 4/6, and the foot arch type of the footprint 200 is flat foot. When the perpendicular bisecting the medial arch point Pa falls between the flat foot point Pm2 and a middle foot point Pm3, the one-sixth foot type index $FTI_6$ is between 3/6 and 4/6, and the foot arch type of the footprint 200 is low arch. When the perpendicular bisecting the medial arch point Pa falls between the middle foot point Pm3 and a little high foot point Pm4, the one-sixth foot type index $FTI_6$ is between 2/6 and 3/6, and the foot arch type of the footprint 200 is normal arch. When the perpendicular bisecting the medial arch point Pa falls between the little high foot point Pm4 and a high arch point Pm5, the one-sixth foot type index $FTI_6$ is between 1/6 and 2/6, and the foot arch type of the footprint 200 is little high arch. When the perpendicular bisecting the medial arch point Pa falls between the high arch point Pm5 and the lateral common tangent point Po, the one-sixth foot type index $FTI_6$ is smaller than 1/6, and the foot arch type of the footprint 200 is high arch. Furthermore, for some people the foot arch structure collapses due to long time standing or other reasons. In this case, the one-sixth foot type index $FTI_6$ can be adjusted in correspondence. When the one-sixth foot type index $FTI_6$ is between 0.30 and 0.57, the foot arch type of the footprint 200 is normal arch. When the one-sixth foot type index $FTI_6$ is between 0.57 and 0.66, the foot arch type of the footprint 200 is low arch; and when the one-sixth foot type index $FTI_6$ is between 0.16 and 0.30, the foot arch type of the footprint 200 is little high arch.

It should be noted that the one-sixth method is a simplified method, and can be used on a footprint 200 obtained by any tools, such as an electronic scanner, a Harris and Beath footprinting mat, a pressure sensor, a thermal sensor and wet foot test. Once the footprint 200 is obtained, human eyes can be used to identify the foot arch type without calculating the value of the foot type index FTI, and providing suitable insoles or shoes in a short time The preferred embodiments of the present invention have been disclosed in the examples. However, the examples should not be construed as a limitation on the actual applicable scope of the invention, and as such, all modifications and alterations without departing from the spirits of the invention and appended claims, such as adding or subtracting foot arch type categories and defining corresponding foot type index in response to the categorization, shall remain within the protected scope and claims of the invention.

What is claimed is:

1. A method of measuring and identifying foot arch type according to a consumer's footprint data, and providing suitable insoles or shoes in a short time, the method comprising:

obtaining a footprint under a static standing stance, the footprint having a foot contour comprising lateral contour and medial contour;

obtaining a lateral ball tangent point and a lateral heel tangent point of the footprint at points of contact between the lateral contour of the footprint and a lateral common tangent of the lateral contour of the footprint;

obtaining a medial ball tangent point and a medial heel tangent point of the footprint at points of contact between the medial contour of the footprint and a medial common tangent of the medial contour of the footprint;

obtaining a ball mid-point at the mid-point on a line between the lateral ball tangent point and the medial ball tangent point, and a heel mid-point at the mid-point on a line between the lateral heel tangent point and the medial heel tangent point;

obtaining a foot center axial line connecting the ball mid-point and the heel mid-point, the foot center axial line contacting the foot contour at a distal forefoot point and a proximal heel point;

obtaining a foot perpendicular bisector perpendicular to the foot center axial line at a foot center axial line dividing point, the foot center axial line dividing point being a mid-point between the distal forefoot point and the proximal heel point, the foot perpendicular bisector contacting the medial contour at a perpendicular bisecting the medial arch point, the foot perpendicular bisector contacting the medial common tangent at a medial common tangent point, and the foot perpendicular bisector contacting the lateral common tangent at a lateral common tangent point;

obtaining the length of a foot width Lf of a line segment between the medial common tangent point and the lateral common tangent point, and obtaining the width of a foot arch La of a line segment between the perpendicular bisecting the medial arch point and the lateral common tangent point; and calculating a foot type index FTI by dividing the width of the foot arch La by the length of the foot width Lf (FTI=La/Lf), and identifying a foot arch type of the footprint by the foot type index FTI.

2. A method of measuring and identifying foot arch type according to a consumer's footprint data, and providing suitable insoles or shoes in a short time, the method comprising:

obtaining a footprint under a static standing stance, the footprint having a foot contour comprising lateral contour and medial contour;

obtaining a lateral ball tangent point and a lateral heel tangent point of the footprint at points of contact between the lateral contour of the footprint and a lateral common tangent of the lateral contour of the footprint;

obtaining a medial ball tangent point and a medial heel tangent point of the footprint at points of contact between the medial contour of the footprint and a medial common tangent of the medial contour of the footprint;

obtaining a ball mid-point at the mid-point on a line between the lateral ball tangent point and the medial ball tangent point, and a heel mid-point at the mid-point on a line between the lateral heel tangent point and the medial heel tangent point;

obtaining a foot center axial line connecting the ball mid-point and the heel mid-point, the foot center axial line contacting the foot contour at a distal forefoot point and a proximal heel point;

obtaining a foot perpendicular bisector perpendicular to the foot center axial line at a foot center axial line dividing point, the foot center axial line dividing point being a mid-point between the distal forefoot point and the proximal heel point, the foot perpendicular bisector contacting the medial contour at a perpendicular bisecting the medial arch point, the foot perpendicular bisector contacting the medial common tangent at a medial common tangent point, and the foot perpendicular bisector contacting the lateral common tangent at a lateral common tangent point;

obtaining the length of a foot width Lf of a line segment between the medial common tangent point and the lateral common tangent point; and dividing the line segment with the length of the foot width Lf equally into six segments, and identifying a foot arch type of the footprint according to position of the perpendicular bisecting the medial arch point on the segments.

3. The method of measuring and identifying foot arch type according to claim 2, wherein an one-sixth foot type index $FTI_6$ is obtained by dividing a length between the perpendicular bisecting the medial arch point and the lateral common tangent point by the foot width length Lf, and:

when the perpendicular bisecting the medial arch point falls between the medial common tangent point and a flat foot point, the one-sixth foot type index $FTI_6$ is larger than 4/6, and the foot arch type of the footprint is flat foot;

when the perpendicular bisecting the medial arch point falls between the flat foot point and a middle foot point, the one-sixth foot type index $FTI_6$ is between 3/6 and 4/6, and the foot arch type of the footprint is low arch;

when the perpendicular bisecting the medial arch point falls between the middle foot point and a little high foot point, the one-sixth foot type index $FTI_6$ is between 2/6 and 3/6, and the foot arch type of the footprint is normal arch;

when the perpendicular bisecting the medial arch point falls between the little high foot point and a high arch point, the one-sixth foot type index $FTI_6$ is between ⅙ and ⅔, and the foot arch type of the footprint is little high arch; and when the perpendicular bisecting the medial arch point falls between the high arch point and the lateral common tangent point, the one-sixth foot type index $FTI_6$ is smaller than ⅙, and the foot arch type of the footprint is high arch.

4. The method of measuring and identifying foot arch type according to claim 3, wherein when the footprint is a print with foot arch structure collapsing:

when the one-sixth foot type index $FTI_6$ is between 0.30 and 0.57, the foot arch type of the footprint is normal arch;

when the one-sixth foot type index $FTI_6$ is between 0.57 and 0.66, the foot arch type of the footprint is low arch; and when the one-sixth foot type index $FTI_6$ is between 0.16 and 0.30, the foot arch type of the footprint is little high arch.

* * * * *